US010295257B2

(12) United States Patent
Fragnito et al.

(10) Patent No.: US 10,295,257 B2
(45) Date of Patent: May 21, 2019

(54) DRYING A REFRIGERATED CARGO BOX FOLLOWING WASH OUT PRIOR TO LOADING

(71) Applicant: Carrier Corporation, Farmington, CT (US)

(72) Inventors: Mark G. Fragnito, Watkinsville, GA (US); John R. Reason, Liverpool, NY (US); David C. Brondum, Cazenovia, NY (US); Deborah A. Champagne, North Syracuse, NY (US)

(73) Assignee: CARRIER CORPORATION, Farmington, CT (US)

( * ) Notice: Subject to any disclaimer, the term of this patent is extended or adjusted under 35 U.S.C. 154(b) by 422 days.

(21) Appl. No.: 14/438,898

(22) PCT Filed: Aug. 28, 2013

(86) PCT No.: PCT/US2013/056953

§ 371 (c)(1),
(2) Date: Apr. 28, 2015

(87) PCT Pub. No.: WO2014/070292

PCT Pub. Date: May 8, 2014

(65) Prior Publication Data

US 2016/0169580 A1 Jun. 16, 2016

Related U.S. Application Data

(60) Provisional application No. 61/720,065, filed on Oct. 30, 2012.

(51) Int. Cl.
*F26B 3/06* (2006.01)
*A24B 3/04* (2006.01)
(Continued)

(52) U.S. Cl.
CPC ..... *F26B 21/02* (2013.01); *F26B 25/00* (2013.01); *F26B 19/005* (2013.01)

(58) Field of Classification Search
CPC ..... F26B 19/005; F26B 21/02; F26B 21/086; F26B 3/02; F26B 3/06; F26B 21/08;
(Continued)

(56) References Cited

U.S. PATENT DOCUMENTS 1,593,598 A * 7/1926 Redman ..... F26B 9/06 34/225
3,086,533 A * 4/1963 Touton ..... A24B 3/04 131/302

(Continued)

FOREIGN PATENT DOCUMENTS

KR 20050012309 A 2/2005
KR 20050023480 A 3/2005

(Continued)

OTHER PUBLICATIONS

International Search Report for application PCT/US2013/056953, dated Dec. 2, 2013, 6 pages.

(Continued)

*Primary Examiner* — Frantz Jules
*Assistant Examiner* — Martha Tadesse
(74) *Attorney, Agent, or Firm* — Cantor Colburn LLP

(57) ABSTRACT

A method is provided for accelerating the drying of a cargo box (18) of a refrigerated truck (12), trailer (16), or container following a wash out. In an aspect, the method includes circulating air from the cargo box (18) through an evaporator (30) of the refrigerant unit (20) and back to the cargo box (18); and operating the refrigerant unit (20) in alternating cycles of first heating the circulating air and then cooling the circulating air.

11 Claims, 2 Drawing Sheets

(51) Int. Cl.
*F26B 21/02* (2006.01)
*F26B 25/00* (2006.01)
*F26B 19/00* (2006.01)

(58) Field of Classification Search
CPC ..... F26B 23/005; A24B 3/04; B60H 1/3232; F25D 2700/12; Y02P 70/405
See application file for complete search history.

(56) References Cited

U.S. PATENT DOCUMENTS 3,472,040 A * 10/1969 Taylor ..... F24F 5/001 165/283
3,694,925 A 10/1972 Coyle et al.
3,768,274 A * 10/1973 Fink ..... F25B 41/04 62/159
3,939,573 A * 2/1976 Berti ..... F26B 3/04 34/471
3,965,696 A * 6/1976 Thomason ..... A23B 5/02 62/324.3
4,003,728 A 1/1977 Rath
4,020,562 A * 5/1977 Weyermann ..... C12C 1/073 34/212
4,255,870 A * 3/1981 Malmquist ..... F26B 21/04 34/212
4,899,549 A 2/1990 Berge
5,065,587 A * 11/1991 Howland ..... B60H 1/3232 200/61.62
5,127,233 A 7/1992 Coffield
5,172,560 A 12/1992 Jurewicz
5,259,553 A 11/1993 Shyu
5,400,608 A 3/1995 Steed et al.
5,457,963 A 10/1995 Cahill-O'Brien
5,974,815 A 11/1999 Hwang et al.
6,199,300 B1 * 3/2001 Heater ..... D06F 58/28 34/446
6,223,454 B1 * 5/2001 Fingerson ..... A24B 3/04 34/427
6,892,807 B2 5/2005 Fristedt et al.
7,765,831 B2 8/2010 Rodriguez et al.
2003/0039298 A1 2/2003 Eriksson et al.
2010/0256824 A1 10/2010 Val-Khvalabov et al.
2011/0162394 A1 * 7/2011 Lee ..... F24F 11/0008 62/93
2015/0159923 A1 * 6/2015 Akisawa ..... F25B 17/08 62/324.6

FOREIGN PATENT DOCUMENTS

WO 8504001 A1 9/1985
WO 2012003202 A2 1/2012

OTHER PUBLICATIONS

Truckers Report, "Getting a Reefer to dry out quickly after unload", www.thetruckersreport.com/truckingindustryforum/refrigerated-trucking-forum/179895-getting-reefer-dry-out-quickly-after.html, Nov. 22, 2013, 4 pages.
Written Opinion for application PCT/US2013/056953, dated Dec. 2, 2013, 6 pages.

* cited by examiner

DRYING A REFRIGERATED CARGO BOX FOLLOWING WASH OUT PRIOR TO LOADING

BACKGROUND OF THE DISCLOSURE

This disclosure relates generally to the transport of perishable goods and, more particularly, to the preparation of a refrigerated cargo box for transport of a non-refrigerated product on a return leg of a transport haul after delivery of a refrigerated product.

Refrigerated trucks, trailers and mobile containers are customarily equipped with a transport refrigeration unit operatively associated with the cargo box of the truck, trailer or mobile container for cooling the atmosphere within the cargo box. The transport refrigeration unit includes a refrigerant vapor compression system having a refrigerant evaporator heat exchanger. When transporting temperature sensitive perishable goods, ranging for example from fresh products, such as produce, meat and fish to frozen goods, such as deep frozen seafood, air from within the cargo box of the truck, trailer or container, is circulated through an evaporator heat exchanger in heat exchange relationship with refrigerant circulating through the refrigerant vapor compression system. Box air is drawn from the cargo box, referred to as return air, passed through the evaporator heat exchanger of a refrigeration vapor compression system of the transport refrigerant unit to cool the box air, and then circulated back to the cargo box. The air circulated back to the cargo box is referred to as supply air.

After a refrigerated perishable product is delivered and unloaded from the cargo box of the truck, trailer or container, the truck, trailer or container may be hired to haul non-refrigerated perishable, dry product, such as for example, but not limited to, bags of flour or sugar or other dry goods for the return leg. In such case, it is customary to wash out the cargo box of the truck, trailer or container. The cargo box must then be allowed to dry out prior to loading the non-refrigerated perishable, dry product. Depending upon local ambient conditions, the natural drying of the cargo box may take several hours, resulting in delays in loading and departure, costly downtime, poor equipment utilization rates, scheduling issues, and general lack of productivity.

SUMMARY OF THE DISCLOSURE

A method is provided for accelerating the drying of a cargo box of a refrigerated truck, trailer, or container following a wash out. In an aspect, the method includes circulating air from the cargo box through an evaporator of the refrigerant unit and back to the cargo box; and operating the refrigerant unit in alternating cycles of first heating the circulating air and then cooling the circulating air.

In an embodiment of the method, operating the refrigerant unit in alternating cycles of first heating the circulating air and then cooling the circulating air includes: heating the circulating air for a first period and upon expiration of the first period cooling the circulating air for a second period; and repeating the alternate heating and cooling cycles for a preset drying period of time. In each heating cycle, heating the circulating air for a first period may include heating the circulating air for a preset period of heating time. In each cooling cycle, cooling the circulating air for a second period may include cooling the circulating air until the circulating air passing back to the cargo box has been cooled to a preselected temperature.

The method may further include at the completion of each cooling cycle determining whether the elapsed time from commencement of the drying process exceeds a preset drying period of time; and if the elapsed time from commencement of the drying process exceeds the preset drying period of time, terminating the drying process. The method may further include, upon termination of the drying process, operating the refrigeration unit in a defrost cycle for defrosting the evaporator.

In an aspect, a method is provided for removing moisture from a cargo box of a mobile refrigerated container equipped with a refrigeration unit following a wash out of the cargo box by selectively operating the refrigerant unit in a remove moisture mode. The method includes: operating a fan operatively associated with an evaporator of the refrigeration unit for circulating air from the cargo box through the evaporator and back to the cargo box; determining whether a sensed ambient temperature is less than the freezing point of water; and if the sensed ambient temperature is less than the freezing point of water, operating the refrigeration unit in alternating cycles of first heating the circulating air and then cooling the circulating air. The method further includes if the sensed ambient temperature is not less than the freezing point of water, setting the setpoint control air temperature and operating the refrigeration unit in a cooling cycle for cooling the circulating air passing through the evaporator prior to operating the refrigeration unit in alternating cycles of first heating the circulating air and then cooling the circulating air.

In an embodiment, operating the refrigeration unit in alternating cycles of first heating the circulating air and then cooling the circulating air includes: operating the refrigeration unit in a heating cycle and heating the circulating air passing through the evaporator for a preset heating period of time; upon termination of the heating cycle, setting a setpoint control air temperature and operating the refrigeration unit in a cooling cycle for cooling the circulating air passing through the evaporator; sensing a temperature of the circulating air having traversed the evaporator and being supplied back to the cargo box; comparing the sensed supply air temperature to the setpoint control air temperature; and terminating operation of the refrigeration unit in the cooling cycle when the sensed supply air temperature equals the setpoint control air temperature.

The method may further include: determining an elapsed time from initiating operation of the refrigeration unit in the remove moisture mode; if the elapsed time is less than a preset drying period of time, repeating another heating cycle and cooling cycle sequence; and if the elapsed time equals or exceeds the preset drying period of time, terminating operation of the refrigeration unit in the remove moisture mode.

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE DISCLOSURE

Figure 1:
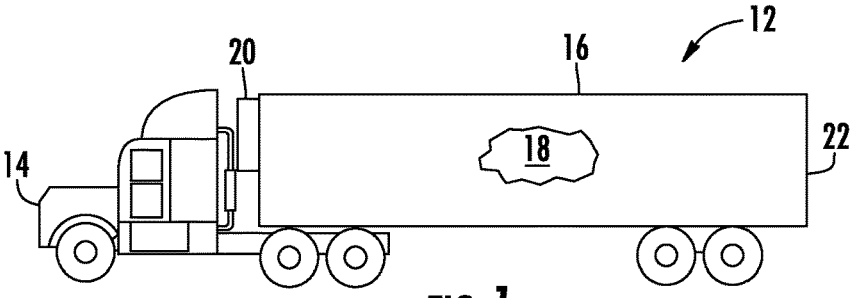
FIG. 1 is a side elevation view of a refrigerated transport tractor-trailer equipped with a transport refrigeration unit for conditioning the atmosphere within the cargo box of the trailer.

Referring initially to FIG. 1, there are depicted a refrigerated transport vehicle 12 adapted for transporting perishable goods in a temperature controlled environment. In the depicted embodiment, the refrigerated transport vehicle 12 is a refrigerated tractor-trailer having a tractor 14 pulling a trailer 16 defining a cargo box 18 wherein goods are stowed for transport. A transport refrigeration unit (commonly referred to as a TRU) 20 is mounted to the trailer 16, for example to the front wall of the trailer 16, for establishing and maintaining a temperature-controlled environment within the cargo box 18 after the goods are loaded into the cargo box 18 and the doors 22, typically in the rear wall of the trailer 16 are closed to seal the cargo box 18.

Figure 2:
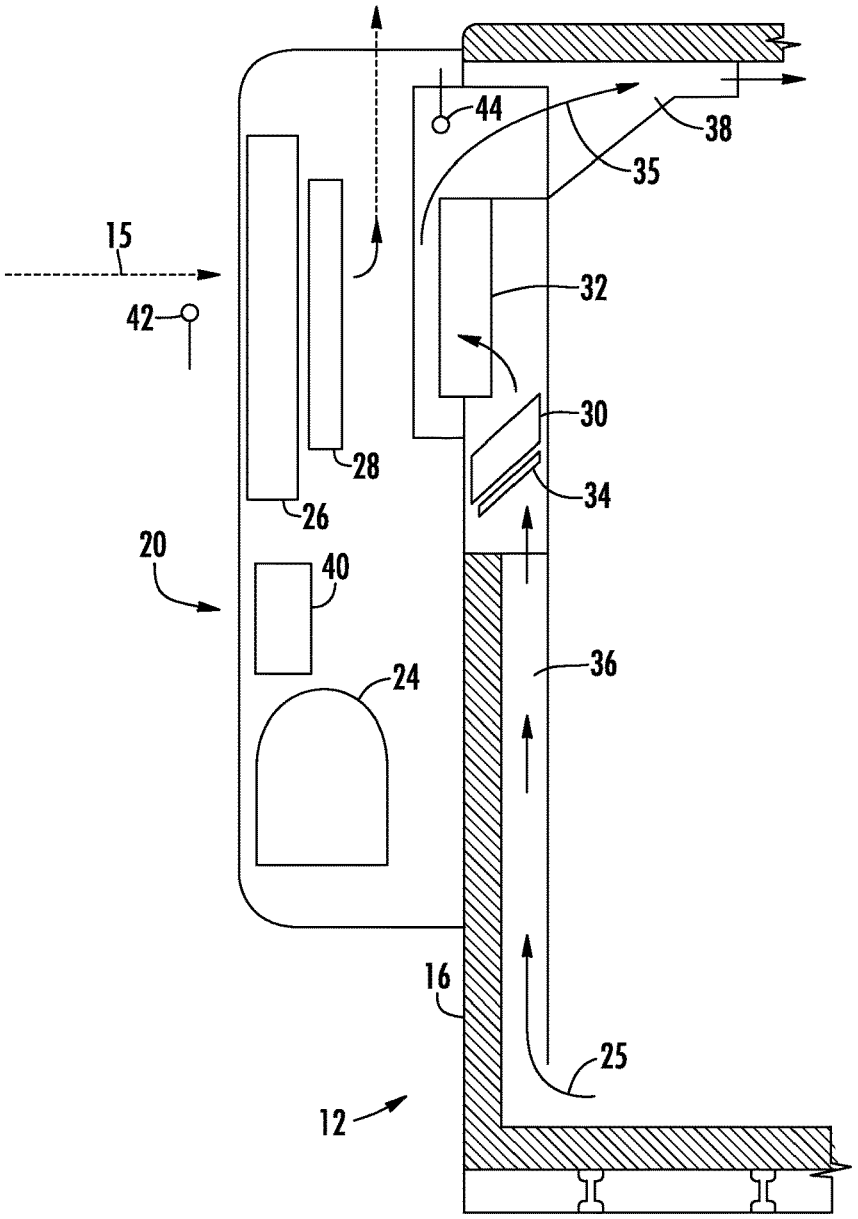
FIG. 2 is a side elevation view of an embodiment of the transport refrigeration unit mounted on the front wall of the trailer of FIG. 1.

Referring now to FIG. 2, the TRU 20 includes a refrigerant vapor compression system having a compression device 24, a refrigerant heat rejection heat exchanger 26 and at least one fan 28 associated therewith, and a refrigerant heat absorption heat exchanger 30 and at least one fan 32 associated therewith. The refrigerant heat rejection heat exchanger 26, which functions as refrigerant condenser if the refrigerant vapor compression system is operating in a subcritical refrigeration cycle and as a refrigeration gas cooler if the refrigerant vapor compression system is operating in a transcritical refrigeration cycle, will be referred to herein as condenser/gas cooler 26. The compression device 24, the condenser/gas cooler 26 and associated fan(s) 28 are located in a forward section of the TRU 20 located external from and thermally isolated from the cargo box 18. The compression device 24 typically comprises a reciprocating compressor or a scroll compressor, but other types of compressors may be used.

In a tractor-trailer application, the TRU 20 further includes a prime mover (not shown), typically in the form of a Diesel engine, that either drives the compression device 24 directly through a mechanical coupling or a belt or chain drive, or drives a generator (not shown) that provides electric power for driving an electric motor for driving the compression device 24. In truck applications, the compression device 24 may be driven by electric power provided from a generator driven by the truck engine. In intermodal refrigerated container applications, the compression device may be driven by an electric motor powered by an onboard ship electric power supply or by electric power generated by a genset coupled to the TRU when the intermodal container is not onboard ship.

The refrigerant heat absorption heat exchanger 30, which functions as an evaporator whether the refrigerant vapor compression system is operating in a subcritical or a transcritical cycle, will be referred to herein as evaporator 30. The evaporator 30 and the evaporator fan(s) 32 are housed in an aft section of the TRU 20 in air flow communication with the interior of the cargo box 18 through a return air duct 36 and a supply air duct 38, as illustrated in FIG. 2. When the evaporator fan(s) 32 are operating, air is drawn from the cargo box 18 through the return duct 36, traversing the evaporator 30, and circulated back to the cargo box 18 through the supply air duct 38.

The compression device 24, the condenser/gas cooler 26, an expansion device (not shown), typically a thermostatic expansion valve or an electronic expansion valve, operatively associated with the evaporator 30, and the evaporator 30 are disposed in series refrigerant flow relationship in a closed loop refrigerant flow circuit and arranged to carry out a conventional refrigeration cycle. An electric heating element 34 may be disposed on the return air side, that is the upstream side with respect to air flow, of the evaporator 30. Thus, the refrigerant vapor compression system may be selectively operated in a cooling mode to cool the atmosphere within the closed environment within the cargo box 18 or in a heating mode to heat the atmosphere within the closed environment within the cargo box 18 so as to maintain the temperature within the cargo box 18 within a narrow range about a desired box temperature for the particular perishable product, fresh or frozen, being transport.

The TRU 20 also includes a controller 40 in association with the refrigerant vapor compression system for controlling operation of the refrigerant vapor compression system in both the cooling mode and the heating mode. In an embodiment, the controller 40 may a microprocessor based controller. The controller 40 is configured to control operation of the compression device 24, as well as operation of the fan(s) 28 associated with the condenser/gas, the fan(s) 32 associated with the evaporator 30, the electric heating element 34, and various valves and other components through the refrigerant vapor compression system. The controller 40 is also configured to monitor various operating parameters, such as refrigerant pressures and/or refrigerant temperatures at various locations within the refrigerant flow circuit. Additionally, the controller 40 is configured to monitor the temperature, $T_{AM}$, of the ambient air 15 external of the trailer 12 through a temperature sensor 42, and the temperature of the supply air, $T_{SA}$, having traversed the evaporator 30 and passing back to the cargo box 18 through the supply air duct 38, through a temperature sensor 44.

Figure 3:
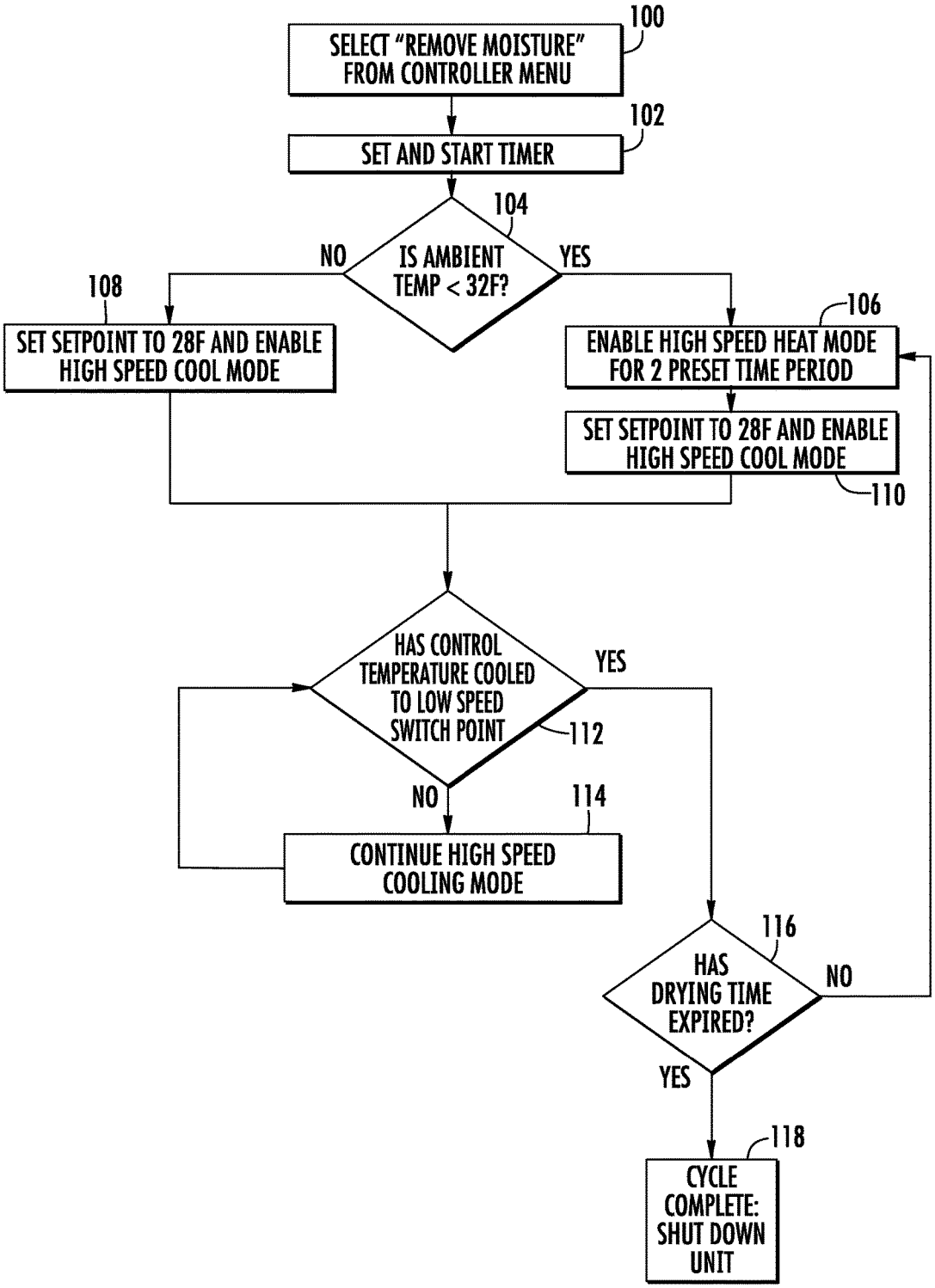
FIG. 3 is a process flow block diagram illustrating an embodiment of the method for removing moisture disclosed herein.

Referring now to FIG. 3, there is presented a process flow block diagram illustrating an embodiment of the method for removing moisture from the atmosphere within a cargo box of a refrigerated transport vehicle for accelerating the drying of the cargo box following a wash out of the cargo box. To initiate drying of the cargo box 18 after a wash out, the operator, at block 100, selects a "Remove Moisture" option from a menu on a display associated with the controller 40. Of course, prior to initiating the drying process, the operator ensures that the doors 22 to the cargo box 18 are closed to seal the cargo box 18.

Having been instructed to enter a remove moisture mode, the controller 40, at block 102, sets a timer for a desired elapsed period of drying time and starts the timer. The period of drying time may be selected by the operator or may be preprogrammed into the controller 40. For example, a period of drying time of one hour should be sufficient in most applications, although shorter or longer periods of drying time may be specified as desired. At block 104, the controller 40 determines whether the current ambient air temperature, $T_{AM}$, external to the cargo box 18, as sensed by the ambient air temperature sensor 42, is less than the freezing point of water (32° F., 0° C.). If the current ambient air temperature, $T_{AM}$, is indeed less than 32° F., 0° C., the controller 40 proceeds to block 106. However, if the current ambient air temperature is equal to or greater than, i.e. not less than, 32° F., 0° C., the controller 40 proceeds to block 108.

If the current ambient air temperature, $T_{AM}$, is indeed less than 32° F., 0° C., the controller 40 initiates operation of the refrigerant vapor compression system in alternating cycles, first, at block 106, entering a heating cycle for heating the circulating box air to condition the box air for taking up moisture from the surfaces of the bounding walls of the cargo box 18 and then, at block 110, entering a cooling cycle for cooling the circulating box air and removing moisture therefrom as the circulating box air traverses the evaporator 30. In the cooling cycle, as the circulating air traverses the evaporator 30, moisture condenses from the circulating box air onto the heat exchange surfaces of the evaporator, drains into a condensate collection pan (not shown) and out therefrom into the environment external of the trailer 12. The controller 40 sequences the refrigerant vapor compression system from operation in the heating cycle after a preset heating period of time has elapsed in the heating mode at block 106 to operation in the cooling cycle at block 110. The preset heating period of time for operation in a heating cycle, for example, may be ten minutes, but shorter or longer periods of may be used if desired.

During operation in the cooling cycle, the controller 40, at block 112, monitors the supply air temperature, $T_{SA}$, sensed by the supply air temperature sensor 44, and continuously determines whether the supply air temperature, $T_{SA}$, has been cooled to a desired lower temperature below the freezing point of water, such as, for example, but not limited to 28° F. (−2.2° C.). If not, the controller 40 continues operating the refrigerant vapor compression system in the cooling cycle (block 114). When the sensed supply air temperature has dropped to the desired lower temperature, the controller 40, at block 116, determines whether the drying period timer set at step 102 has expired. If the timer has not expired, the controller 40 returns to block 106 of the process flow chart and switches operation of the refrigerant vapor compression system into another heating cycle at block 106 to continue the alternate heating cycle/cooling cycle process.

To determine whether the drying period timer has expired, the controller 40, at block 116, compares the total elapsed time since commencement of the drying process at block 102 to the preset period of drying time to which the timer was set at step 102. If the total elapsed time since commencement of the drying process equals or exceeds the preset period of drying time to which the timer was set at step 102, the controller 40 terminates the current cooling cycle and at block 118, terminates operation of the refrigerant vapor compression system. If desired, the controller 40 may be configured to initiate a defrost cycle for defrosting the evaporator 40 following termination of the cooling cycle at the point at which the total elapsed time has reached or exceed the preset drying period of time so as to melt any frost from the evaporator heat exchange surface and drain the resulting water to the exterior environment through the condensate pan drain.

Returning now to block 104 of the process block diagram shown in FIG. 3, if the current ambient air temperature sensed by the ambient air temperature sensor 42 is not less than 32° F., 0° C., that is if the current ambient air temperature equals or exceeds the freezing point of water, the controller 40 proceeds to block 108, rather than to block 106, and initiates operation of the refrigerant vapor compression system in an initial cooling cycle. If the ambient air temperature is at or above 32° F., 0° C., the temperature of the box air within the cargo box 18 following a wash out will also be at or above 32° F., 0° C., and therefore will already have a moisture content sufficient to warrant first operating the refrigerant vapor compression system in a cooling cycle to remove that moisture from the circulating box air prior to sequencing the refrigerant vapor compression system through alternating heating and cooling cycles at blocks 106-110 as described hereinbefore.

During operation in the initial cooling cycle at block 108, the controller 40, at block 112, monitors the supply air temperature, $T_{SA}$, sensed by the supply air temperature sensor 44, and continuously determines whether the supply air temperature, $T_{SA}$, has been cooled to a desired lower temperature less than the freezing point of water. If not, the controller 40 continues operating the refrigerant vapor compression system in the cooling cycle (block 114). When the sensed supply air temperature has dropped to the desired lower temperature, the controller 40, at block 116, determines whether the drying period timer set at step 102 has expired. If the timer has not expired, the controller 40 returns to block 106 and switches operation of the refrigerant vapor compression system into another heating cycle at block 106 to begin a sequence alternate heating and cooling cycle as hereinbefore described.

Upon entering a heating cycle, the controller 40 operates the evaporator fan(s) 32 and powers on the electric heating element 34. Referring again to FIG. 2, the evaporator fan(s) 32 draw return air 25 from the cargo box 18 through return air duct 36 to traverse the activated heating element 34 whereby the circulating box air is heated. After traversing the heating element 34, the circulating traverses the evaporator 30 and the evaporator fan(s) 32 and is passed as supply air 35 through the supply air duct 38 into the cargo box 18. In the heating mode, because the compression device is generally not operating, there is no cooling of the circulating box air as it traverses the evaporator 30.

Upon entering a cooling cycle, the controller 40 operates the compression device 24 to circulate refrigerant through the condenser/gas cooler 26 and the evaporator 30, the condenser fan(s) 28 to draw ambient air through the condenser/gas cooler, and the evaporator fan(s) 32 to circulate box air through the evaporator 30. In a cooling cycle, the electric heating element 34 is not activated. The evaporator fan(s) draw return air 25 from the cargo box 18 through return air duct 36 to traverse the deactivated heating element 34 and the evaporator 30. As the circulating air traverses the evaporator 30, the air passes in heat exchange relationship with the refrigerant whereby the refrigerant is evaporated and the box air cooled. The cooled circulating box air is passed as supply air 35 through the supply air duct 38 into the cargo box 18.

If the evaporator fan(s) 32 are capable of operating selectively at a low speed and a high-speed or a variable speed, either continuously variable or stepped variable, in embodiment of the method disclosed herein, the evaporator fan(s) 32 may be operated in a high speed heating in the heating cycle at block 106 and in a high speed cooling mode in the cooling cycle at box 110. In such an embodiment, at block 112, the controller 40 is configured to determine whether the supply air temperature, $T_{SA}$, has cooled to a preset switch point temperature at which the controller 40 is configured to automatically switch to low-speed fan operation. For example, the preset switch point temperature may be preprogramed in the controller 40 to be the control temperature plus 2 degrees to avoid overshoot when the refrigerant vapor compression system is operating in a pulldown mode or a temperature maintenance mode. During operation in the remove moisture mode, it is desirable to keep the evaporator fan(s) 32 operating at a high speed at all times due to the desire to accelerate the drying process as much as possible.

The heating cycle as described hereinbefore with respect to the embodiment of the TRU depicted in FIG. 2 uses an electric heating element 34 for heating the circulating air. Because the power draw of the electric heating element is not insignificant, the electric heating element is typically available only on TRU' s having an onboard generator driven by an onboard prime mover. However, it is to be understood that the method for drying the transport cargo box is also applicable to drying cargo boxes having associated therewith a TRU that includes a compressor driven by belt or chain drive off the prime mover or mechanically coupled to a drive shaft of the prime mover. In such an embodiment, no electric heating element is provided and the heating mode is carried out by a conventional process commonly known as hot gas bypass, wherein hot refrigerant vapor discharging from the compressor is passed directly to and through the evaporator heat exchanger, thereby bypassing the condenser/gas cooler.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present invention not be limited to the particular embodiment(s) disclosed as, but that the invention will include all embodiments falling within the scope of the appended claims.

We claim:

1. A method for conditioning an empty cargo box of a mobile refrigerated container equipped with a refrigeration unit, the method comprising:

prior to loading cargo into the empty cargo box, performing operations to dry the cargo box by removing moisture from the cargo box, the operations comprising:

circulating air from the cargo box through an evaporator of the refrigerant unit and back to the cargo box; and operating the refrigerant unit in alternating cycles of first heating the circulating air and then cooling the air.

2. The method as recited in claim 1 wherein operating the refrigerant unit in alternating cycles of first heating the circulating air and then cooling the air comprises:

heating the circulating air for a heating period and upon expiration of the heating period, cooling the circulating air for a cooling period; and repeating said alternate heating and cooling cycles for a preset drying period of time.

3. The method as recited in claim 2 wherein in each heating cycle heating the circulating air for a heating period comprises heating the circulating air for a preset heating period of time.

4. The method as recited in claim 2 wherein in each cooling cycle cooling the circulating air for a cooling period comprises cooling the circulating air until the circulating air passing back to the cargo box has been cooled to a preselected temperature.

5. The method as recited in claim 2 wherein in each heating cycle heating the circulating air for a heating period comprises heating the circulating air for a preset heating period of time and in each cooling cycle cooling the circulating air for a cooling period comprises cooling the circulating air until the circulating air passing back to the cargo box has been cooled to a preselected temperature.

6. The method as recited in claim 5 further comprising:

at the completion of each cooling cycle determining whether the elapsed time from commencement of the drying process exceeds the preset drying period of time; and if the elapsed time from commencement of the drying process exceeds the preset drying period of time, terminating the drying process.

7. The method as recited in claim 6 further comprising upon termination of the drying process operating the refrigeration unit in a defrost cycle for defrosting the evaporator.

8. A method for conditioning an empty cargo box of a mobile refrigerated container equipped with a refrigeration unit, the method comprising:

prior to loading cargo into the empty cargo box, performing operations comprising:

operating a fan operatively associated with an evaporator of the refrigeration unit for circulating air from the cargo box through the evaporator and back to the cargo box;

determining whether a sensed ambient temperature external to the cargo box is less than the freezing point of water;

when the sensed ambient temperature is less than the freezing point of water, operating the refrigeration unit in a heating cycle and heating the circulating air passing through the evaporator for a preset heating period of time;

when the sensed ambient temperature is not less than the freezing point of water or upon termination of the heating cycle, setting a setpoint control air temperature and operating the refrigeration unit in a cooling cycle for cooling the circulating air passing through the evaporator;

sensing a temperature of the circulating air having traversed the evaporator and being supplied back to the cargo box;

comparing the sensed supply air temperature to the setpoint control air temperature; and when the sensed supply air temperature equals the setpoint control air temperature, then performing:

determining an elapsed time from initiating operation of the refrigeration unit in the remove moisture mode;

if the elapsed time is less than a preset drying period of time, repeating the heating cycle and cooling cycle sequence; and if the elapsed time equals or exceeds the preset drying period of time, terminating operation of the refrigeration unit in the remove moisture mode.

9. The method of claim 1, further comprising:

washing out the cargo box prior to the loading cargo into the cargo box.

10. The method of claim 8, further comprising:

washing out the cargo box prior to the loading cargo into the cargo box.

11. The method of claim 1, further comprising:

selecting a remove moisture option from a menu of a display associated with a controller of the refrigeration unit to initiate the circulating and the operating.

* * * * *